US006605892B1

(12) United States Patent
Seibold et al.

(10) Patent No.: US 6,605,892 B1
(45) Date of Patent: Aug. 12, 2003

(54) GAS DISCHARGE LAMP AND METHOD FOR THE PRODUCTION THEREOF

(75) Inventors: Michael Seibold, Munich (DE); Michael Ilmer, Augsburg (DE); Angela Eberhardt, Augsburg (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 121 days.

(21) Appl. No.: 09/806,764

(22) PCT Filed: Jul. 28, 2000

(86) PCT No.: PCT/DE00/02500

§ 371 (c)(1),
(2), (4) Date: May 17, 2001

(87) PCT Pub. No.: WO01/11653

PCT Pub. Date: Feb. 15, 2001

(30) Foreign Application Priority Data

Aug. 5, 1999 (DE) ..... 199 36 865

(51) Int. Cl.[7] ..... H01J 9/40; C03B 23/57
(52) U.S. Cl. ..... 313/493; 313/643; 65/34
(58) Field of Search ..... 313/493, 495, 313/643, 634, 624, 625; 65/34, 43, 32.2; 220/2.1 R, 2.2

(56) References Cited

U.S. PATENT DOCUMENTS 4,582,210 A * 4/1986 Morimoto et al. ..... 220/2.2
4,765,820 A * 8/1988 Naganawa et al. ..... 65/36
5,751,107 A 5/1998 Komatsu ..... 313/496

FOREIGN PATENT DOCUMENTS

| | | | |
|---|---|---|---|
| DE | 197 11 892 A1 | | 9/1998 |
| DE | 197 18 395 C1 | | 10/1998 |
| EP | 0 263 379 | | 4/1988 |
| GB | 2124822 | * | 2/1984 |
| WO | 98/49712 | | 11/1998 |

OTHER PUBLICATIONS

Patent Abstracts of Japan, vol. 016, No. 465 (E–1270), Sep. 28, 1992, & JP 04 167331 A (Toshiba Lighting & Technol Corp), Jun. 15, 1992.

Patent Abstracts of Japan, vol. 1997, No. 07, Jul. 31, 1997, & JP 09 086959 A (Toto Ltd), Mar. 31, 1997.

* cited by examiner

*Primary Examiner*—Sandra O'Shea
*Assistant Examiner*—Bao Truong
(74) *Attorney, Agent, or Firm*—Robert F. Clark

(57) ABSTRACT

A gas discharge lamp having a discharge vessel, for example composed of a base plate, front plate (2) and frame (3), has at least one closure element (6) which closes a discharge vessel opening in a gas-tight fashion by virtue of the fact that the closure element (6) was inserted into the discharge vessel opening and subsequently fused. The closure element (6) consists of a material which is low-melting by comparison with the remainder of the discharge vessel, for example sintered glass. It is possible to dispense with an additional connecting means between the closure element (6) and the adjacent wall of the discharge vessel (2).

8 Claims, 2 Drawing Sheets

GAS DISCHARGE LAMP AND METHOD FOR THE PRODUCTION THEREOF

TECHNICAL FIELD

The invention relates to a gas discharge lamp and to its production.

In particular, the invention addresses a gas discharge lamp which is designed for dielectrically impeded discharges, in the case of which, therefore, at least the electrode(s) of one polarity is(are) separated by a dielectric layer from the discharge volume in the discharge vessel of the lamp (dielectrically impeded electrode).

Prior Art

The technology of gas discharge lamps, in particular of gas discharge lamps for dielectrically impeded discharges and, in turn, particularly of flat radiator gas discharge lamps, is presupposed here as prior art. In addition, reference is made as an example to the prior German Patent Application 197 11 890.9 from the same applicant, the disclosure content of which with regard to the lamp technology of flat radiator gas discharge lamps for dielectrically impeded discharges is hereby incorporated by reference.

Moreover, the invention also addresses linear discharge lamps, in particular for dielectrically impeded discharges. Reference is made in this connection to WO98/49712, the disclosure content of which with regard to the lamp technology of linear discharge lamps for dielectrically impeded discharges is hereby incorporated by reference. In the said document, a linear aperture discharge lamp with at least one internal strip-shaped electrode is disclosed. An end of the tubular discharge vessel of the lamp is closed in a gas-tight fashion by a stopper which is fused by means of glass solder to a part of the inner wall of the discharge vessel. The strip-shaped inner electrode is guided to the outside through the glass solder as a supply lead. It is disadvantageous that a glass solder layer is required between the stopper and vessel wall as gas-tight connecting means.

SUMMARY OF THE INVENTION

It is an object of the present invention to provide a gas discharge lamp whose discharge vessel can be closed in a gastight fashion relatively simply.

This object is achieved according to the invention by means of a gas discharge lamp having a discharge vessel and characterized in that the discharge vessel has at least one closure element which is fitted into a discharge vessel opening and fused and thereby closes the discharge vessel opening in a gas-tight fashion.

The basic idea of the invention consists in closing one or more openings in a discharge vessel of a discharge lamp by fusing a closure element fitted into the or each discharge vessel opening. It is possible in this way to dispense with an additional connecting means, for example a glass solder layer as in the prior art, between the closure element and the wall of the discharge vessel opening.

As a result of heating, the softening of the material of the closure element leads to a firm connection and, if appropriate, to matching of shape to the wall of the discharge vessel opening. In general terms, the term of fusing does not necessarily mean a transition into a liquid phase in the actual meaning of the word. Rather, it also conveys an adequate softening which firstly leads to adequate adhesion of the softened material to the vessel wall directly adjacent to the discharge vessel opening and, if required, to matching of the shape thereto. Typically, a viscosity of the closure element of the order of magnitude of $10^6$ dPa·s (decipascal seconds) or less is aimed at in fusing.

In order when fusing the closure element not to impair the lamp itself, that is to say in particular the discharge vessel, possibly joined from a plurality of parts, the electrodes, if appropriate functional layers such as dielectric barriers, fluorescent materials etc., the material of the closure element is selected such that its softening temperature is below that of the remaining materials used, in particular for the discharge vessel. In particular, the softening temperature of the closure element is relatively low, such that typical temperatures for the fusing are in the region of between approximately 350° C. and 600° C., for example 400° C. Firstly, the outgasings, occurring at relatively high temperatures, from the materials of the discharge vessel can thereby be suppressed or at least kept relatively slight. Furthermore, the thermal loading of the discharge vessel becomes relatively slight, as a result of which mechanical damage owing to strains or thermal changes in the material can be virtually avoided. Typically, at the fusing temperature the viscosity of the closure element is at least two, and more preferably, at least three powers of ten lower than that of the discharge vessel, with a substantially higher softening temperature, 520° C. in the example.

Each closure element is a prefabricated semi-finished product, for example a moulded part made from sintered glass, for example lead borosilicate (Pb—Si—B—O), bismuth borosilicate glass (Bi—Si—B—O), zinc borosilicate glass (Zn—Si—B—O) zinc bismuth borosilicate glass (Zn—Bi—Si—B—O) or phosphate glass (SnO—ZnO—$P_2O_5$). The discharge vessel consists, by contrast, of a glass usual for this purpose, such as soda-lime silicate glass.

Such an opening closed according to the invention by fusing a closure element can be a filling opening for evacuating and filling which must be closed after the filling. In this case, the closure element can take the form, for example, of a stopper which is inserted after the filling into the filling opening and subsequently fused and thereafter closes the filling opening in a gas-tight fashion. However, a sleeve with a thickened edge, that is to say a type of collar with a bore which serves as the actual filling opening here is also suitable as closure element. This variant has the advantage that the closure element can already be inserted into the opening of the discharge vessel before the filling. After the filling, the closure element need only further be fused, and thereby the opening be closed in a gas-tight fashion.

Moreover, however, the opening can also be one through which, for example, an electrical lead-through is laid and which is to be closed tightly, the intention being to seal the lead-through. It is favourable in this case, as well, to provide the closure element that is to be fused as a thickened edge of the opening. Upon softening, the glass can then close the opening uniformly from all sides of the opening. If the opening is a filling opening, the diameter of the opening can be 1–5 mm, for example.

As already mentioned at the beginning, the invention preferably addresses flat radiator discharge vessels. These can be mounted on a base plate and a front plate as well as a frame connecting the two plates. A favourable arrangement of a filling opening can be situated in the frame in this case, because the emission of light is thereby impaired to a particularly slight extent. This also holds, in particular, for electrical lead-through. However, arrangements in the base plate or in the top plate are also possible, skilful accommodation in an edge region being preferable, in order not to disturb the emission of light and the course of the discharge electrodes.

Linear discharge lamps are also less affected by the problems of the specific favourable arrangement of a filling opening, since a discharge tube firstly necessarily has at its two ends one opening each which is suitable for filling, and these have to be closed, for example, by the closure elements according to the invention.

Heating for the purpose of fusing the closure element can be realized in any case by thermal radiation, in a furnace or by means of an IR radiator, for example, or by a flame.

With regard to the device suitable for such method steps, the invention further addresses the carrying out of the method in a vacuum furnace for the purpose of evacuating and filling in simultaneous conjunction with a temperature which is raised under control.

The invention is explained below in more concrete terms with the aid of a plurality of exemplary embodiments, it being possible for the features disclosed in this case also to be essential to the invention individually or in combinations other than those illustrated.

DETAILED DESCRIPTION OF THE INVENTION

In the two exemplary embodiments, illustrated in FIGS. 1–5, of the invention, a filling opening in a discharge vessel is closed with a glass closure element by fusing. In accordance with the first exemplary embodiment, the closure element can be arranged in one of the plates, while in accordance with the second one it can be arranged in the frame of a flat radiator discharge vessel.

Figure 1:
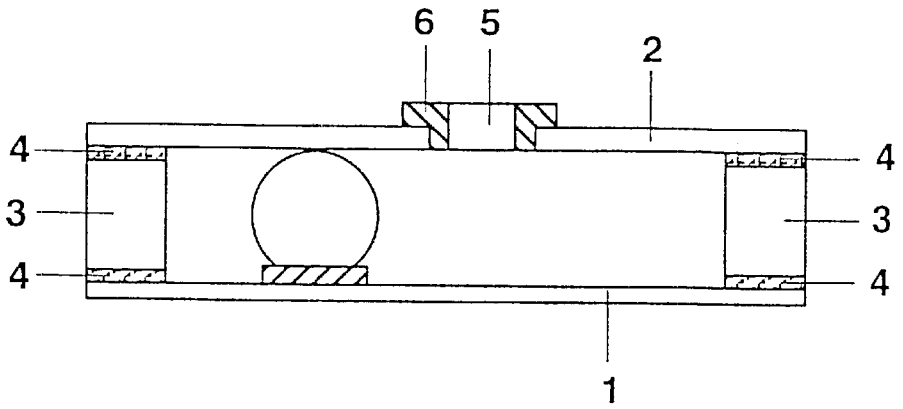
FIG. 1 shows a diagrammatic cross-sectional view through a flat radiator discharge vessel before the closure according to the invention in accordance with a first exemplary embodiment according to the invention.
Figure 2:
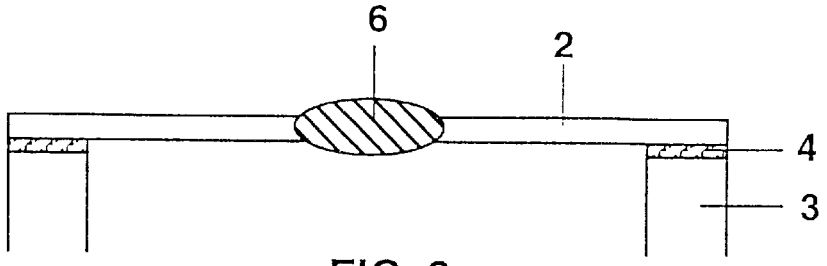
FIG. 2 shows an illustration of a detail relating to FIG. 1, with closed filling opening.

FIG. 1 shows a diagrammatic cross section through a flat radiator discharge vessel. In this case, the number 1 denotes a base plate, and the number 2 a front plate, and the number 3 denotes a frame which connects the two plates. These components consist of soda-lime silicate glass and have been connected to one another in a preceding jointing method step via a glass solder layer denoted by 4. The resulting discharge vessel has a substantially rectangular cross section and (not illustrated) a rectangular plan. It serves to produce a flat radiator with dielectrically impeded discharges for back lighting of a flat display screen, or else for general lighting. Consequently, electrode strips are imprinted on the side, situated at the top in the figure, of the base plate 1 inside the region delimited by the frame 3, a portion of the electrodes being covered with a dielectric layer. These details are not of further interest here, and therefore are not illustrated. Reference is made to the disclosure content of the application 197 11 890.0 already quoted.

In any case, the presence of the electrode strips on the base plate 1 is the reason for the arrangement of a filling opening 5 in the front plate 2. In this case, the filling opening 5 in FIG. 1 is situated essentially in the middle, for the sake of simplicity; however, in a concrete embodiment preference is given to an edge position for reasons already explained.

A glass sleeve 6 in the form of a thickened collar is inserted as closure element into the filling opening 5. The closure element 6 consists of a relatively low-melting sintered glass, for example lead borosilicate glass (Pb—Si—B—O). This closure element 6 is heated in a heating phase to a temperature of approximately 400° C., as a result of which it softens to a viscosity of below $10^6$ sdPa·s, and is drawn into the filling opening 5 as drop by the surface tension. After cooling, the filling opening 5 is sealed in the way illustrated diagrammatically in FIG. 2, the relatively slight heating required for the softening of the closure element 6 not impairing the remainder of the discharge vessel. It is indicated in the drawing that the closure element 6 closing the filling opening 5 produces a slight waviness by comparison with the remainder of the front plate 2. The arrangement near the wall already mentioned is to be preferred for this reason.

Figure 3:
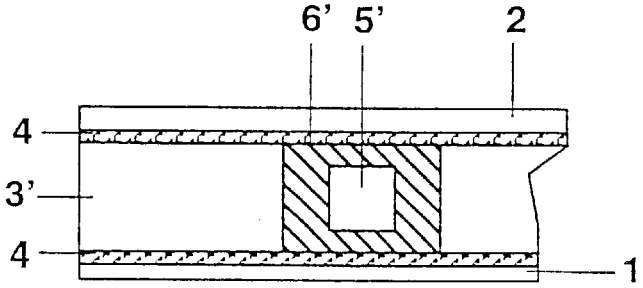
FIG. 3 shows an illustration of a detail with an alternative filling opening relating to FIG. 1 before the closure, in accordance with a second exemplary embodiment according to the invention.
Figure 4:
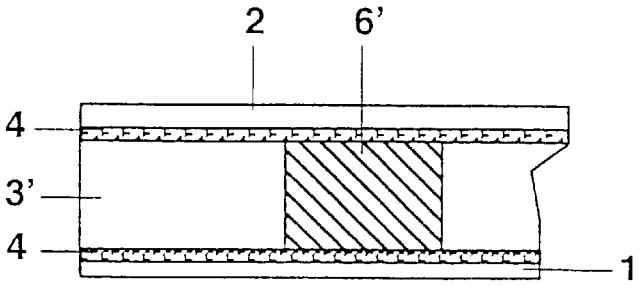
FIG. 4 shows the exemplary embodiment of FIG. 3 after the closure.

An alternative to this is shown by FIGS. 3 and 4, the as yet unclosed state of a filling opening 5' being illustrated in FIG. 3, and the closed state in FIG. 4. In accordance with FIG. 3, a filling opening 5' is provided in a frame 3', and so the frame 3' has a hole. A collar sleeve 6', which otherwise corresponds to the above explanations relating to FIG. 1, is inserted into the filling opening 5' in a way similar to that illustrated in FIG. 1.

After the heating phase up to the softening point of the closure element 6', the filling opening 5' is closed by the fused closure element 6', as illustrated in FIG. 4. This variant offers the advantage of the least possible impairment of the light-emitting properties of the gas discharge lamp.

Figure 5:
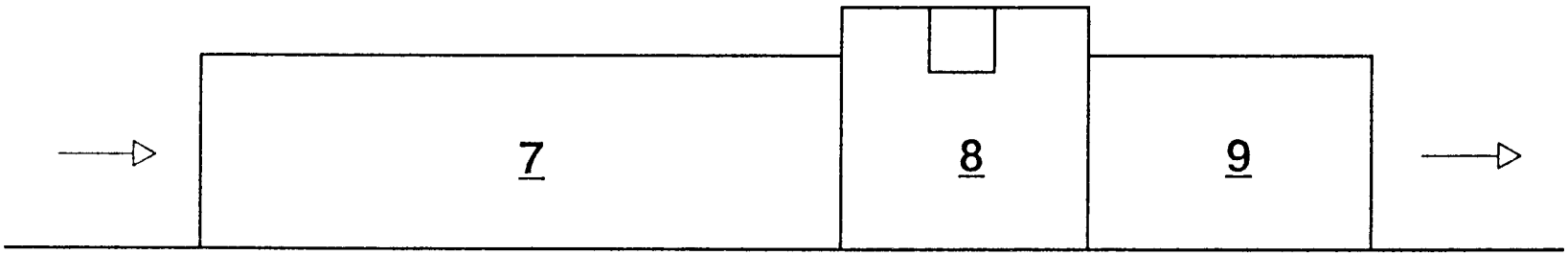
FIG. 5 shows a diagrammatic illustration of a production line for the method according to the invention.

In accordance with FIG. 5, the part of the method of production according to the invention is performed in a diagrammatically illustrated production line composed of three stations 7, 8 and 9. As is evident from the arrow drawn in on the left in FIG. 5, a structure assembled from the base plate 1, the front plate 2, the frame 3 and the closure element 6 and provided at the suitable points with glass solder 4 is passed into the first station 7, a continuous furnace for assembling these semi-finished products. The discharge vessel is assembled therein by heating to a temperature of between 240° and 520° C. In this case, there is a protective gas atmosphere present in the continuous furnace. The contaminants emerging at the raised temperatures, in particular binders emerging from the glass solder 4, are driven out by thorough purging.

The temperature in the continuous furnace 7 is raised so far that the glass solder 4 softens at a viscosity of the jointing solder of substantially below $10^6$ dPa·s, and connects the parts to be assembled. Temperatures of 520° C. are typically required for this purpose. The protective gas atmosphere serves essentially to prevent oxidation of the fluorescent material (not illustrated in the figures) in the discharge vessel at the raised temperatures. There is no need in stations 7 for a vacuum furnace (which is substantially more complicated and therefore more expensive).

After the assembly and cooling to a temperature with a viscosity of the glass solder 4 of above $10^{10}$ dPa·s, the discharge vessel is passed into the second station 8, the closure element 6 still corresponding to the state illustrated in FIGS. 1 and 3. The interior of the discharge vessel is therefore still open above the filling opening 5. Consequently, pumping off is performed in the vacuum furnace 8 through the filling opening 5, the discharge vessel being kept at a raised temperature of 250–300° C. required to support further desorption processes and suitable with regard to the following fusing of the closure element 6.

The closure element can also alternatively not be applied until in the vacuum furnace 8.

After sufficient pumping-off, an atmosphere corresponding to the desired gas filling of the gas discharge lamp is produced in the vacuum furnace 8, and penetrates into the discharge vessel through the filling opening 5. The lamp, including the closure element 6, is now heated to a temperature of approximately 400° C., as a result of which the said element fuses and is drawn into the filling opening 5 as drop by the surface tension. Thereafter, the lamp or the closure element 6 is cooled and hardens in the shape illustrated in FIGS. 2 and 4, and closes the gas filling enclosed in the discharge vessel.

The closed discharge vessel is then passed into the third station 9, a further continuous furnace, and cooled there to approximately 50° C. by a defined control of the furnace temperature or by transporting the lamp along a path, corresponding to a defined temperature profile, inside the continuous furnace 9. In accordance with the arrow drawn in on the right in FIG. 5, the finished discharge vessel can be extracted thereafter. Since, as already mentioned, the discharge vessel is one already provided with electrode strips and lead-through of the same (compare the application 197 11 890.9 already quoted), the gas discharge lamp is thereby essentially finished.

Although the invention has been explained in more detail with reference to a flat radiator, its advantageous effect is also retained with other vessel geometries, in particular in the case of the already mentioned linear discharge lamps, for example, aperture lamps for office automation and for automobile engineering.

Moreover—as already mentioned—the closure element can also not be inserted into the discharge vessel opening until after the lamp is filled, and then be fused. Of course, in this variant the closure element no longer requires to have its own filling opening, but can be designed, for example, as a type of stopper which then likewise closes the discharge vessel opening in a gas-tight fashion after it has been fused.

What is claimed is:

1. A gas discharge lamp comprising a discharge vessel having a base plate, a front plate and a frame connecting the base plate and the front plate, the discharge vessel having a filling opening in the front plate or the frame, the filling opening being fitted with a closure element comprising a collar and sleeve having a bore, the closure element consisting of a material having a softening temperature below the softening temperature of the discharge vessel materials, the closure element when softened by heating fusing to the discharge vessel and closing the filling opening in a gas-tight fashion.

2. The discharge lamp of claim 1 wherein the closure element consists of one or more compounds selected from Pb—Si—B—O, Bi—Si—B—O, Zn—Si—B—O, and SnO—ZnO—$P_2O_5$.

3. A gas discharge lamp comprising a discharge vessel having a base plate, a front plate and a frame connecting the base plate and the front plate, the discharge vessel having a filling opening in the front plate or the frame, the filling opening being fitted with a closure element comprising a stopper, the closure element consisting of a material having a softening temperature below the softening temperature of the discharge vessel materials, the closure element when softened by heating fusing to the discharge vessel and closing the filling opening in a gas-tight fashion.

4. The discharge lamp of claim 3 wherein the closure element consists of one or more compounds selected from Pb—Si—B—O, Bi—Si—B—O, Zn—Si—B—O, and SnO—ZnO—$P_2O_5$.

5. A method for producing a gas discharge lamp comprising:

(a) fitting a closure element in a filling opening of a discharge vessel, the discharge vessel having a back plate, a front plate and a frame connecting the front and back plates, the filling opening being in the front plate or the frame, the closure element comprising a collar and sleeve having a bore, the closure element consisting of a material having a softening temperature below the softening temperature of the discharge vessel materials;

(b) heating the discharge vessel to a temperature sufficient to cause the closure element to soften and fuse to the discharge vessel thereby closing the filling opening in a gas-tight fashion.

6. The method of claim 5 wherein the closure element is heated to a temperature at which its viscosity is $10^6$ dPa·s or less.

7. The method of claim 5 wherein the temperature is between approximately 350° C. and 600° C. during fusing.

8. The method of claim 5 wherein the viscosity of the closure element during fusing is at least three powers of ten less than that of the remainder of the discharge vessel.

* * * * *